US010622762B1

(12) United States Patent
McKee

(10) Patent No.: US 10,622,762 B1
(45) Date of Patent: Apr. 14, 2020

(54) ELECTRICAL CABLE CONNECTORS WITH BREAK-AWAY CONSTRUCTIONS

(71) Applicant: TE Connectivity Corporation, Berwyn, PA (US)

(72) Inventor: Kevin P. McKee, Hemet, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/247,508

(22) Filed: Jan. 14, 2019

(51) Int. Cl.
*H01R 13/633* (2006.01)
*H01R 13/52* (2006.01)
*H01R 13/639* (2006.01)

(52) U.S. Cl.
CPC ..... *H01R 13/633* (2013.01); *H01R 13/521* (2013.01); *H01R 13/5202* (2013.01); *H01R 13/5213* (2013.01); *H01R 13/639* (2013.01); *H01R 2201/26* (2013.01)

(58) Field of Classification Search
CPC ..... H01R 13/5202; H01R 13/521; H01R 13/5213; H01R 13/633; H01R 13/639; H01R 2201/26; H01R 31/06
See application file for complete search history.

(56) References Cited

U.S. PATENT DOCUMENTS 4,707,046 A * 11/1987 Strand ..... H01R 13/633 439/314
5,332,396 A * 7/1994 Kaneko ..... H01R 13/4538 439/137
6,364,675 B1 * 4/2002 Brauer ..... H01R 13/635 439/159
7,081,024 B2 * 7/2006 Karadimas ..... H01R 13/6456 439/180
8,410,369 B2 * 4/2013 Kim ..... H01R 13/6392 174/153 G
9,819,114 B2 11/2017 McCorkle et al.
10,312,631 B1 * 6/2019 Eveker ..... H01R 13/6205
2005/0170698 A1 * 8/2005 Lai ..... H01R 31/06 439/638
2012/0003861 A1 * 1/2012 Kwasny ..... H01R 13/506 439/474
2016/0336679 A1 * 11/2016 McCorkle ..... H01R 13/506

* cited by examiner

*Primary Examiner* — Oscar C Jimenez

(57) ABSTRACT

Electrical cable connectors comprise first member and second members. The first member has an internal cavity having electrical terminals therein. The second member is disposed within the internal cavity and the electrical terminals extend into an internal cavity of the second member for attachment with an electrical cable. A leak-tight junction is formed between the first and second members and the electrical terminals. The second member is removably connected with the first member by engagement of one or more second member surface features with one or more first member surface features. The surface features of the first member are disposed along an outside surface of the first member wall surface a distance away from the first member open end. The surface features are specifically designed to mechanically disengage from one another at a determined pulling force, to permit the second member to detach from the first member without damage.

20 Claims, 10 Drawing Sheets

ELECTRICAL CABLE CONNECTORS WITH BREAK-AWAY CONSTRUCTIONS

FIELD OF THE INVENTION

Electrical cable connectors as disclosed herein relate to connectors useful for connecting an electrical cable between a vehicle, e.g., a tractor, and a trailer being pulled by the vehicle and, more specifically, to an electrical connector specially constructed to enable detachment in the event that the cable is not disconnected once the vehicle and trailer are decoupled to thereby avoid damaging the connector so as to permit future reuse.

BACKGROUND

Electrical connectors used for making an electrical connection between an electrical cable from a vehicle to a trailer or the like being pulled or towed by the vehicle are known in the art. Such electrical connectors include those used, e.g., by tractor-trailer combinations or the like wherein a truck is coupled to pull one or more trailers. Such trailers have a variety of electrical systems that are powered by the pulling vehicle or tractor. An electrical cable is connected between the tractor and trailer to supply the electrical power to the trailer. An electrical cable connector may be mounted on the trailer in the form of a socket or the like that is configured to accommodate connection with a plug connected to an electrical cable running from the truck. Such a tractor/trailer electrical connector device must meet the SAE J560b (Americas) or ISO 3731 (Europe) connection system standard. Such electrical connectors comprise a cap that operates to retain the plug within the connector during use.

A known problem exists with such connectors, when after disconnecting the trailer from the truck the operator inadvertently fails to disconnect the plug and electrical cable from the connector, which results in the connector being damaged by the plug being pulled therefrom when the truck is moved away. This can result in the cap being broken away from the connector, the connector being broken away from its attachment with the trailer, and/or the plug also being damaged, requiring replacement of the connector and/or plug. Also, damage may be caused to the truck or trailer. Electrical connector constructions known in the art that have attempted to address this issue, however, such are still susceptible to damage and to not fully address the issue. It is, therefore, desired that an electrical connector be constructed in a manner that enables a disconnection to occur in such use instances without damaging the connector, plug and/or truck. It is further desired that such electrical connector be reusable in the event of such a disconnection. It is still further desired that such electrical connector be capable of fitment with existing mountings and like, i.e., be retrofittable, so as to avoid the need for any mounting or installation customization.

SUMMARY OF THE INVENTION

Electrical cable connectors as disclosed herein generally comprise a first member and a second member, wherein the first member comprises a body having an internal cavity extending from an open end to a floor. The first member body has a wall structure extending axially between the open end and floor. In an example, the wall structure may be cylindrical. A number of electrical terminals extend through the floor and into the internal cavity. The second member comprises an internal cavity extending from a second member open end to a second member floor. The second member has a wall structure extending axially between the second member open end and the second member floor. The second member wall structure may be cylindrical. The second member is disposed within the first member internal cavity with the second member wall structure positioned within the first member wall structure. The second member floor is positioned adjacent the first member floor and the second member floor accommodates placement of the electrical terminals therethrough into an internal cavity of the second member. In an example, an elastomeric sealing element is interposed between the first and second member floors to provide a leak-tight seal between the first and second members, and to provide a leak-tight seal with the electrical terminals. The second member is removably connected with the first member by engagement of one or more second member surface features with one or more complementary first member surface features. One of the one or more surface features of the first member is disposed along an outside surface of the first member wall surface a distance away from the first member open end.

In an example, the surface features of the first and second members are designed to permit the second member to be disengaged from the first member under a load of greater than about 10 lbs. In an example, the first member surface feature comprises a projection extending from a portion of the first member wall structure, and the second member comprises surface feature disposed outwardly from the second member wall structure that engages and registers with the projection. In an example, second member includes a sleeve extending concentrically around an outside surface of the second member wall surface, and wherein the second member surface feature extends from the sleeve. In an example, the first member wall structure is interposed between the second member wall structure and the sleeve.

In an example, the second member surface feature comprises a latch extending axially from the second member sleeve and is configured to engage and register with the projection. In an example, the first member comprises a flange extending radially outward a distance from the first member wall surface adjacent the first member floor. In an example, the entirety of the second member as disposed in the first member internal cavity is disposed above the flange. In an example, the first member wall structure includes one or more guide surface features disposed along an outside surface of the first member wall structure to register with complementary surface features of the second member to guide alignment during fitment of the first and second members together.

The electrical cable connector as disclosed herein provides detachable connection within an electrical cable connector, when subject to a determined electrical cable force, by combining the first connector member with the second connector member and causing the surface features to mechanically engage and provide an attached connection therebetween, wherein the first connector member is attached to an external object to thereby fix the first connector member. An electrical cable is inserted into the second connector member internal cavity and makes electrical connection with the electrical terminals disposed therein. In an example, the second connector member includes a cap having a locking element that attaches with a portion of the electrical cable to retain attachment of the electrical cable to the second connector member. Upon imposing a pulling force on the electrical cable of greater than about 10 pounds, the surface features of the first and second connector members are caused to disengage, thereby causing the second connector member to detach along with the electrical cable from the first connector member.

BRIEF DESCRIPTION OF THE DRAWINGS

Electrical cable connectors as disclosed herein will now be described by way of example with reference to the accompanying Figures, of which.

DETAILED DESCRIPTION

Figure 1A:
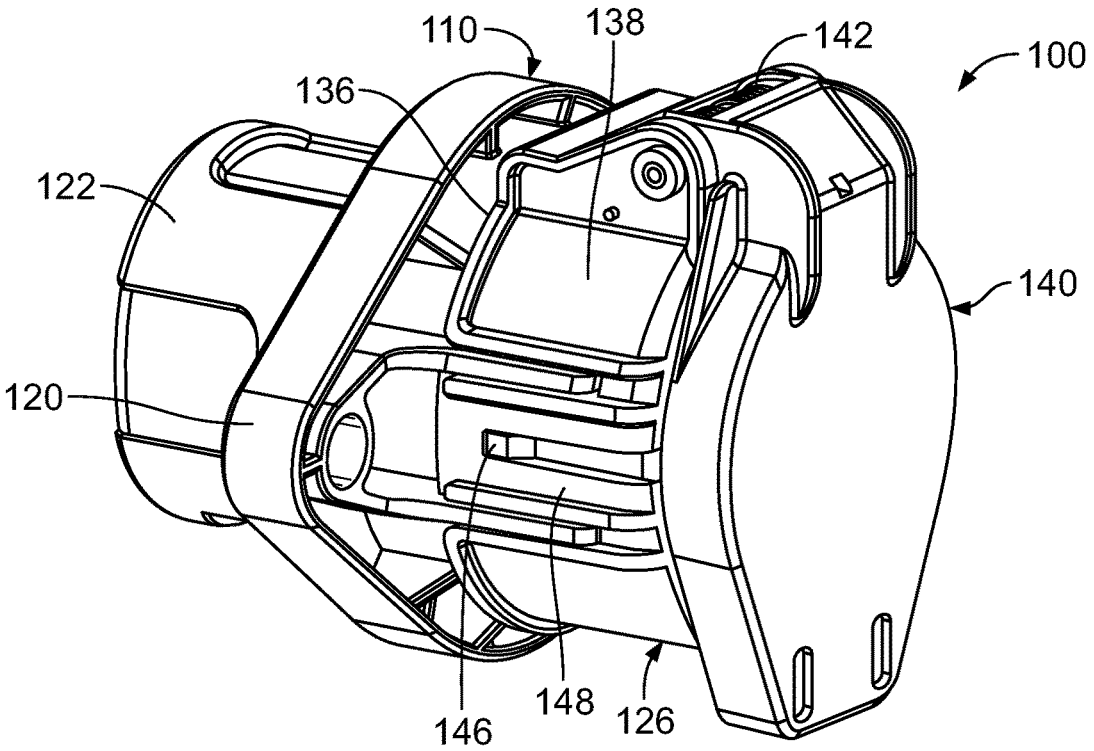
FIGS. 1A to 1C illustrate perspective side views of an example electrical cable connector as disclosed herein.

Embodiments of electrical cable connectors will be described hereinafter in detail with reference to the attached drawings, wherein like reference numerals refer to the like elements. Cable connectors as disclosed herein may, however, be embodied in many different forms and should not be construed as being limited to the embodiments set forth herein; rather, these embodiments are provided so that the disclosure will be thorough and complete, and will fully convey the concept of cable seal systems and connectors to those skilled in the art.

Electrical cable connectors as disclosed herein generally comprise a pair of connector members or receptacles that are configured to fit within one another and promote connection with an external electrical cable to thereby transfer the electricity from the cable through the connector to one or more electrically-powered elements. A feature of such electrical cable connectors is that the pair of connector members are specifically engineered with surface features that operate to retain the pair of connector members together during use, and decouple the pair of connector members (or break away) in the event that the electrical cable has inadvertently been left in the connector while the source of the electrical cable, e.g., a vehicle, is moved away from the connector that is attached to a stationary element, e.g., a trailer. Constructed in this manner, if such event was to occur, the decoupling feature protects the connector and the electrical cable from damage to thereby permit reuse without unwanted repair or replacement.

Electrical cable connectors as disclosed herein are embodied to meet the SAE j560b (Americas) or ISO 3731 (Europe) connection system standard. Thus, such electrical connectors include a SAE-J560b or ISO 3730 connector for connection with an SAE-J560b or ISO 3731 compliant electrical cable plug. In an example, such connectors are for conveying electrical signals from a truck or tractor (generating such signals) to a trailer mechanically coupled for transport by the truck and comprising electrical elements powered from such signals. Additionally, such connectors may be used to convey electrical signals between two or more trailers being transported by a truck or tractor. While such electrical connectors are embodied for such use, it is to be understood that electrical connectors as disclosed and illustrated herein may be used in other end-use applications and be configured as necessary to perform in such other applications. Thus, electrical connectors as disclosed herein are not to be limited to a particular end-use application.

Figure 1B:
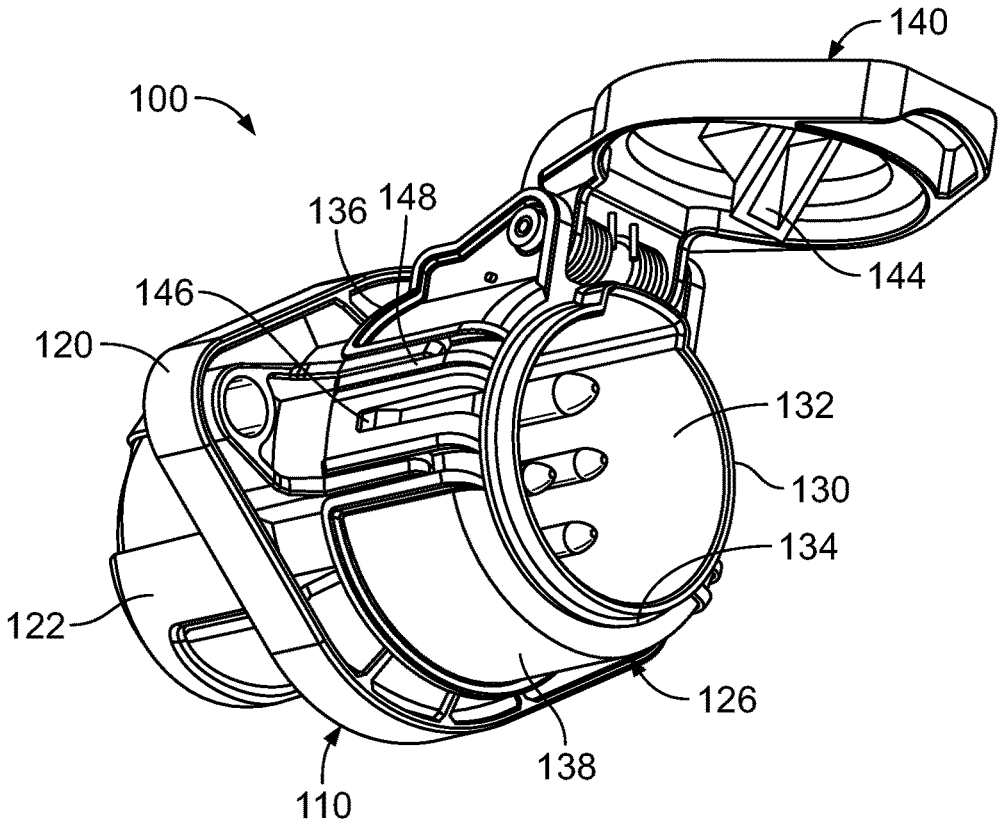
Figure 1C:
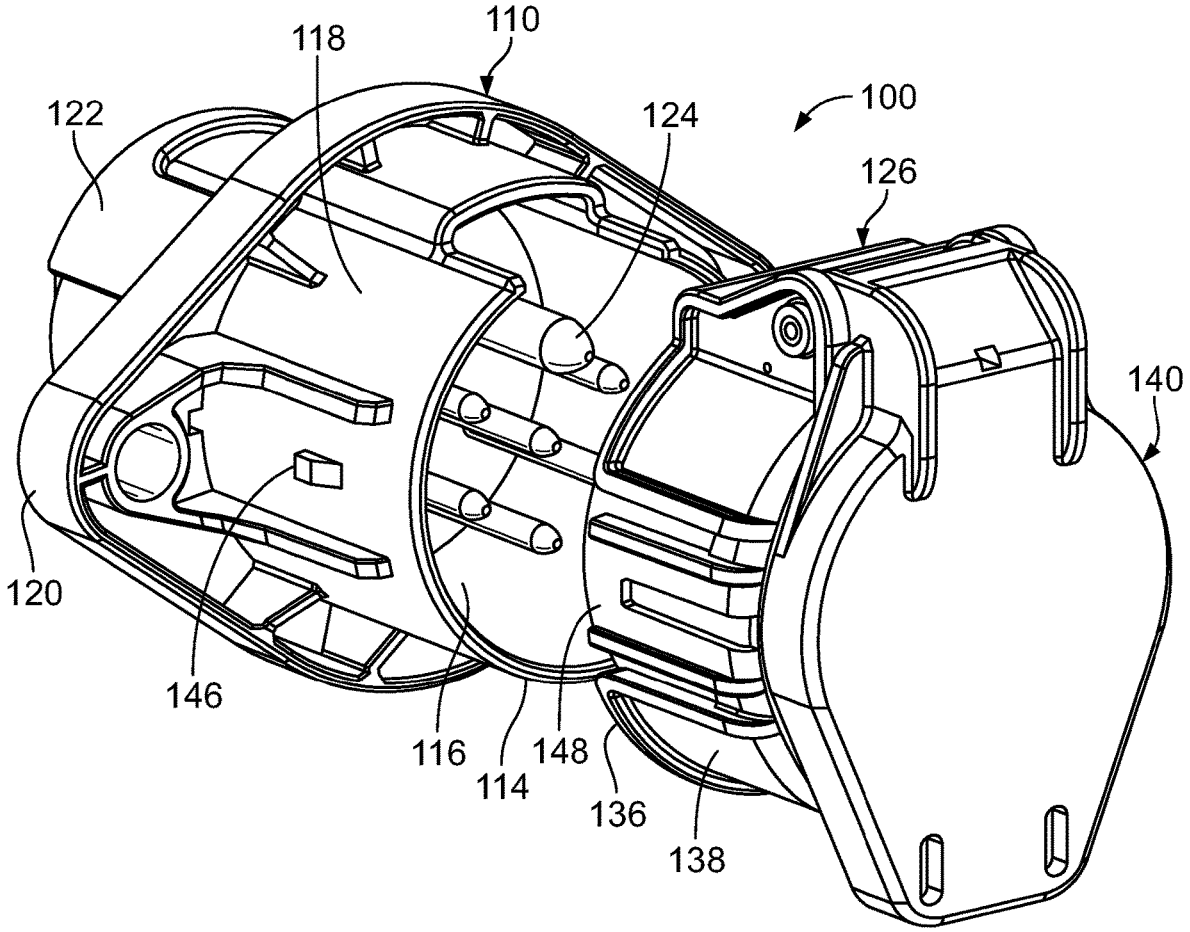

FIGS. 1A to 1C illustrate an example electrical cable connector 100 as disclosed herein in different states of existence. As best shown in FIG. 1C, the connector 100 comprises a first connector member or receptacle 110 comprising a body having an open end 114 and an internal chamber or cavity 116 defined by a wall structure 118 extending axially from the open end to an outwardly projecting flange 120 for attaching the first connector member to an object, such as a trailer or the like to be powered by electricity transferred through the connector. The first connector member 110 includes a second wall structure 122, e.g., having a cylindrical shape, extending axially from an opposite end of the flange 120 for accommodating placement of electrical terminals therethrough and into the first connector member. The internal cavity 116 comprises a number of electrical terminals 124 disposed therein and projecting axially from a floor or base of the cavity towards the open end. In an example embodiment, the first connector member comprises seven electrical terminals or pins as arranged for a J560 type connector. However, it is to be understood that connectors as disclosed herein may be configured having any arrangement of electrical terminals therein as called for by the particular end-use application.

The connector 100 comprises a second connector member or receptacle 126 that is connected with the first connector member 110. In an example, the second connector member 126 includes a body comprising a first open end 130 and an internal cavity 132 disposed therein and defined by a wall structure 134, e.g., having a cylindrical shape, extending axially from the first open end 130 to a second end 136. The second connector member includes a sleeve 138 that is integral with the wall structure 134 and that extends concentrically from the first open end 130 axially along the wall structure 134. The second connector member 126 includes a retractable cap 140 that is hingedly connected thereto and that is biased in a closed position over the first open end 130 by a spring 142 to protect the electrical terminals from corrosion or damage. As best illustrated in FIG. 1B, the cap 140 includes an outwardly projecting element or latch 144 that is configured to engage with a complementary recess in a plug of an electrical cable to maintain engagement of the plug within the connector 100 when in use.

Figure 4A:
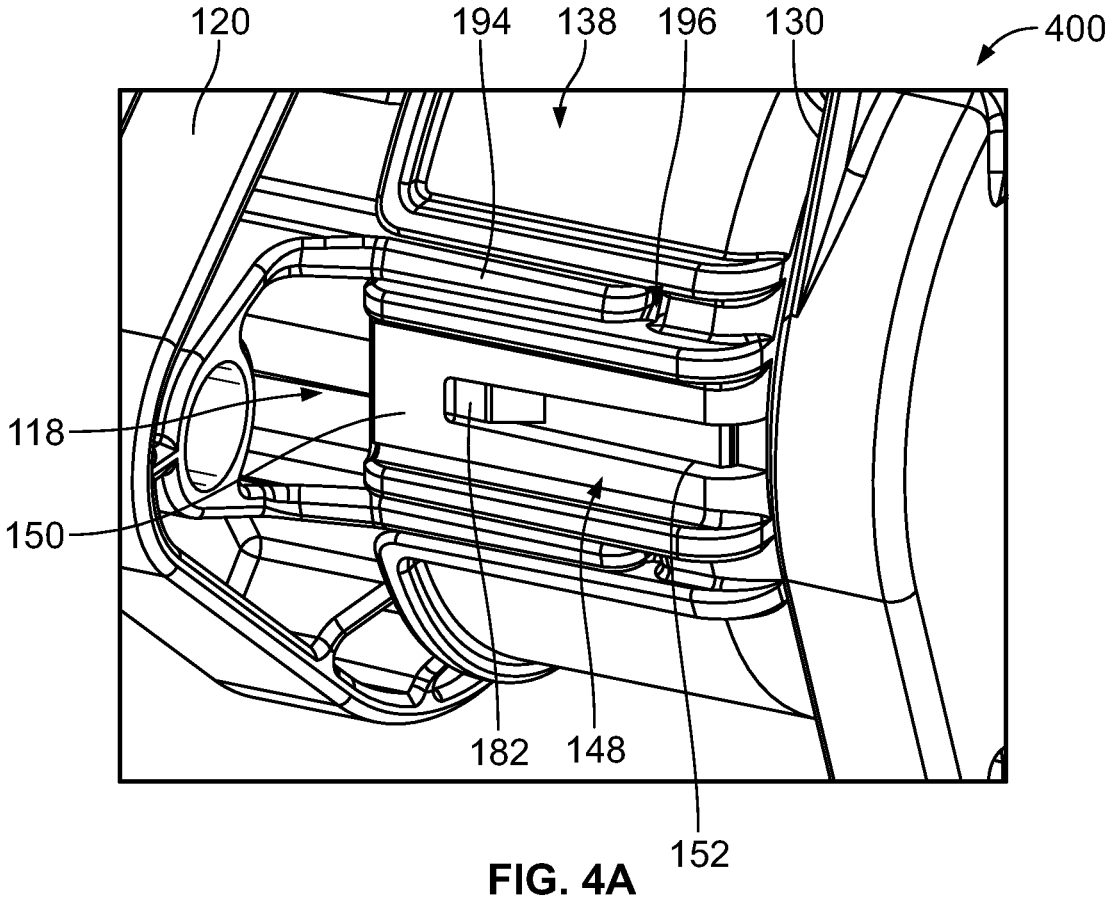
FIGS. 4A and 4B illustrate perspective views of selected portions of an example electrical cable connector as disclosed herein.
Figure 4B:
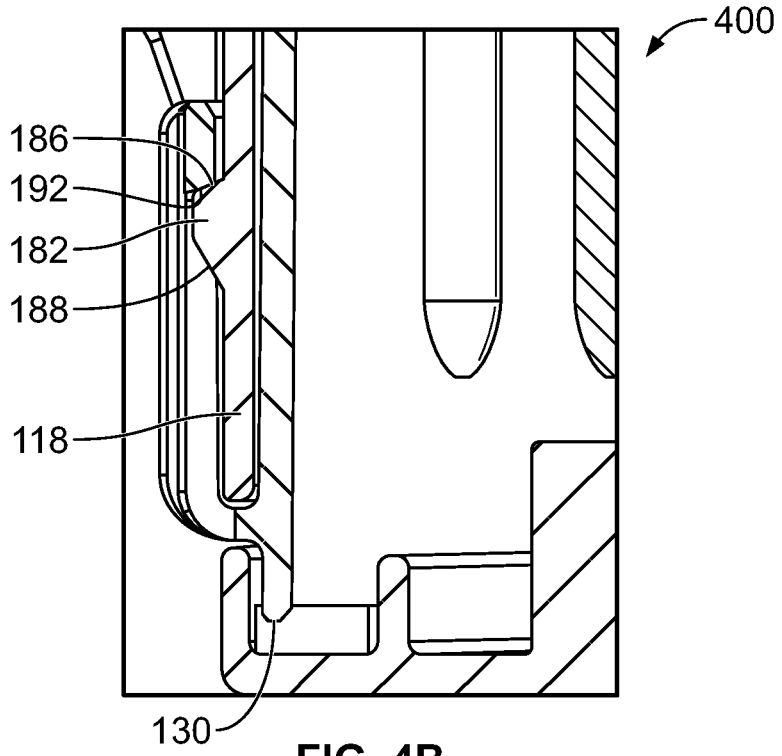

The first connector member 100 comprises a surface feature 146 that is disposed along an outer surface of the wall structure 118 and that is specifically configured to engage with a surface feature 148 of the second connector member 126 when the first and second connector members are joined together, i.e., when the second connector member is disposed within the first connector member internal cavity. In an example, the second connector member surface feature 148 extends from and is integral with the sleeve 138. In an example, the first connector member surface feature 146 is provided in the form of a projection extending a distance radially outwardly from the wall structure 118. As best shown in FIGS. 4A and 4B the second connector member surface feature 148 is in the form of a latch extending axially along the sleeve from the first open end 130 that is configured having a closed end 150 with an open slot 152 to capture the projection when disposed thereover. As better described below, the surface features are specially engineering to decouple or break away when subjected to a threshold force caused by a pulling of the electrical cable on the connector.

Figure 2:
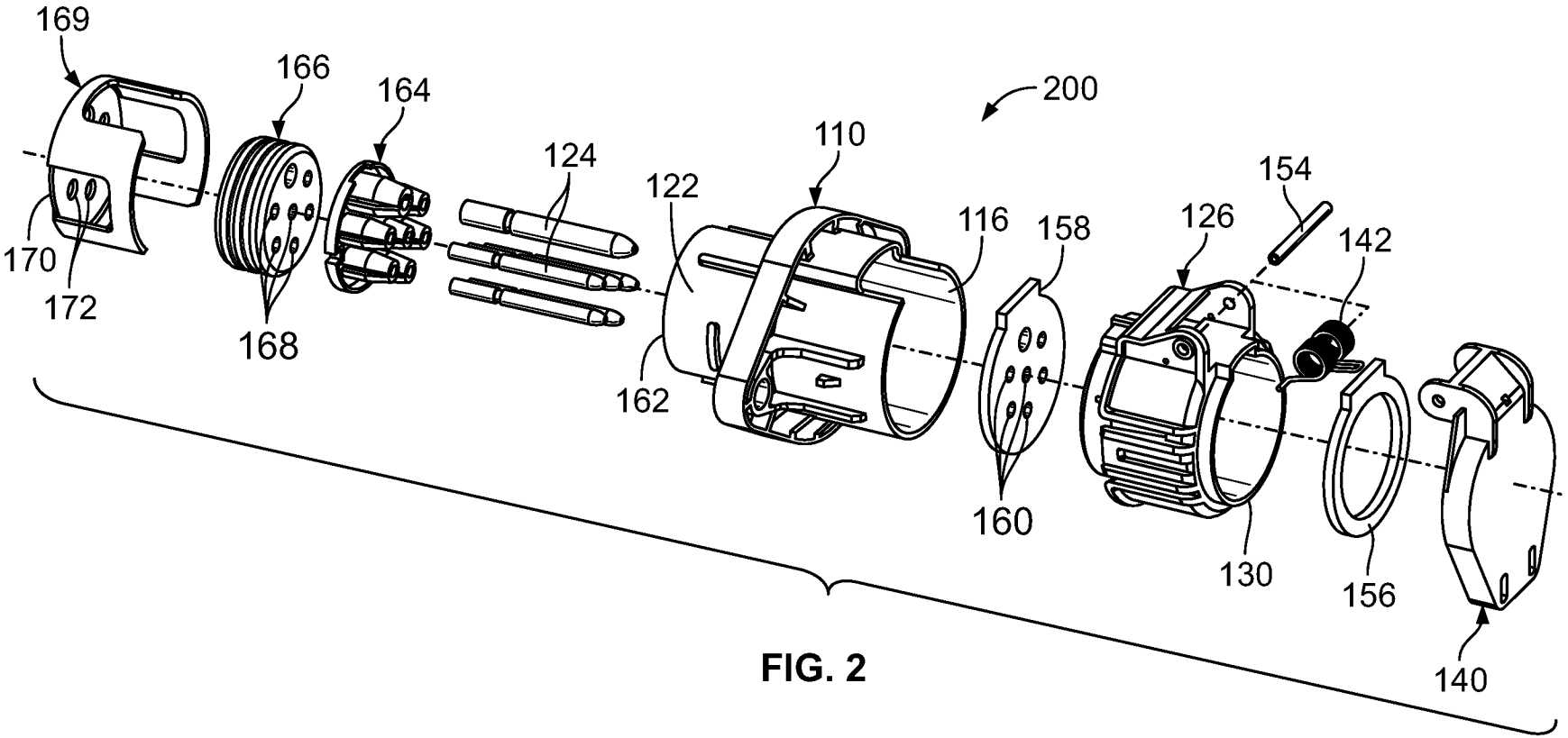
FIG. 2 illustrates a perspective side view of an example electrical cable connector as disclosed herein in an unassembled state.

FIG. 2 illustrates the example electrical cable connector 200 of FIGS. 1A to 1C in an unassembled state comprising, moving from right to left, the cap 140 that is hingedly connected with the second connector member 126 by a pin 154 in a cap attachment assembly. The spring 142 is disposed within the assembly with the pin 154 positioned therethrough and wherein the spring is attached in a manner biasing the cap into a closed position over the first open end 130. An annular seal 156 is interposed between the cap and the first open 130 to provide a leak-tight seal therebetween when the cap is in a closed position. An electrical terminal seal 158 is interposed between the first and second connector members 110 and 126 and comprises a number of openings 160 therethough to accommodate placement of the electrical terminals 124 therethough the provide a leak-tight seal therewith. The seal 158 is disposed along a floor or base of the first connector member internal cavity 116. The electrical terminals 124 are arranged in a desired pattern for insertion into the first connector member 110 through an open end 162 of the second wall structure 122.

An electrical terminal retainer 164 is disposed over a portion of the electrical terminals 124 to both maintain the desired arrangement of the electrical terminals and to retain the electrical terminals for placement within the first connector member. A grommet 166 is provides leak tight seal between the electrical terminals and an inside surface of the second wall structure and includes a number of openings 168 to accommodate passage of the electrical terminals 124 therethough. The electrical terminals 124, retainer 164, and grommet 166 form an electrical terminal assembly and are disposed within an internal cavity of the first connector member second wall structure 122. An electrical terminal assembly retainer cap or cover 169 is configured for attachment, e.g., a removable attachment, with the first connector member second wall structure 122 to retain desired placement of the electrical terminal assembly therein. The retainer cap 169 comprises an end 170 comprising a number of openings 172 disposed therethough to accommodate the passage of electrical wires that are connected within the first connector member to respective electrical terminals 124.

Figure 3A:
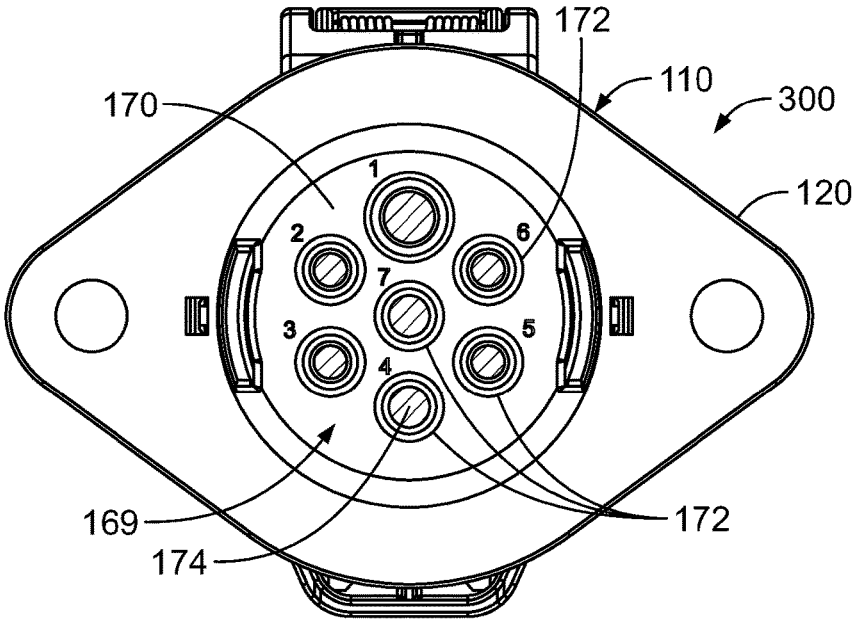
FIGS. 3A to 3C illustrate respective back, side and front views of an example electrical cable connector as disclosed herein.
Figure 3B:
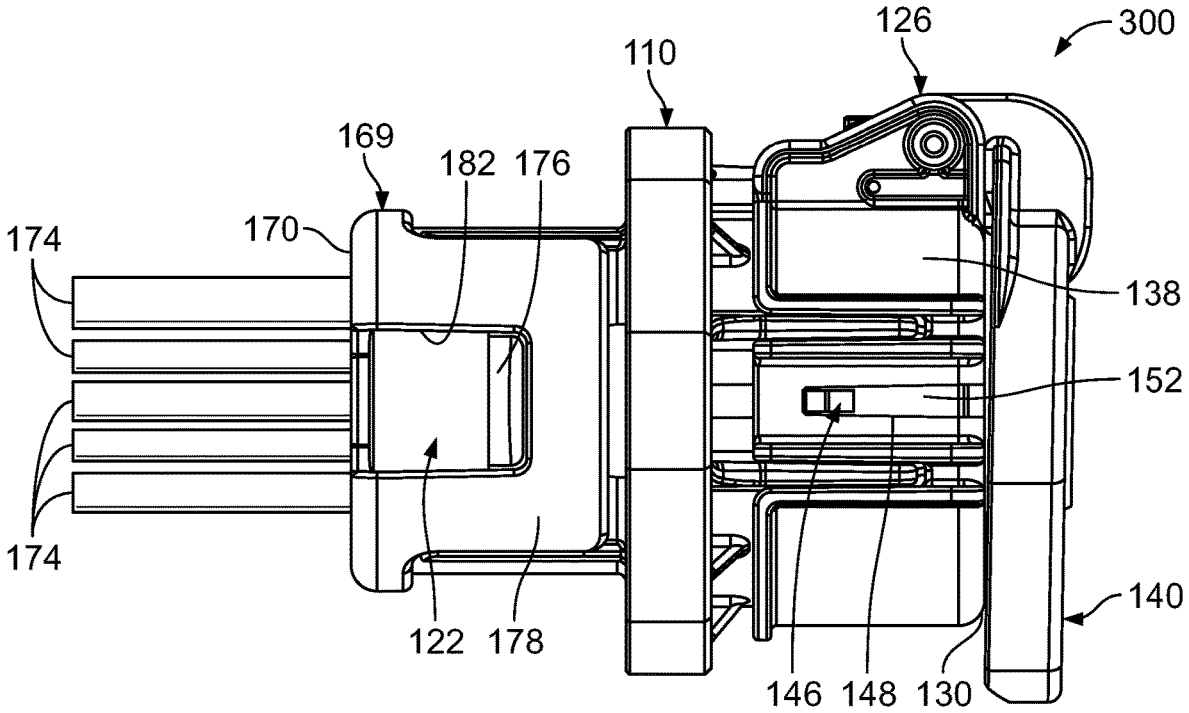
Figure 3C:
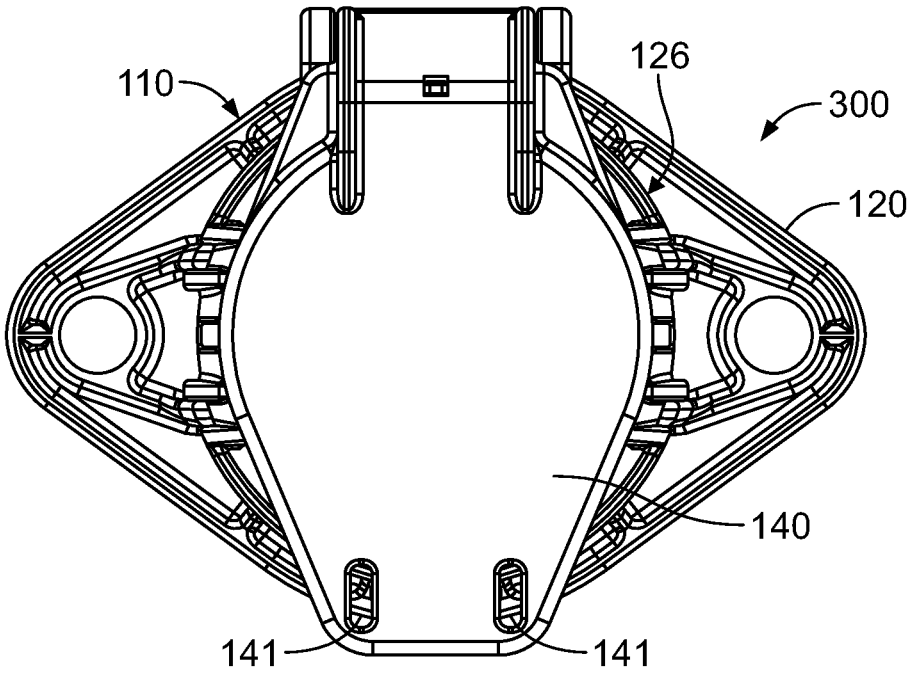

FIGS. 3A to 3C illustrate different views of the electrical cable connector as described above. FIG. 3A shows a back view of the connector 300 illustrating the flange 120 of the first connector member for accommodating fixed connection of the first connector member 110 with an object such as a portion of a trailer or the like to receive electricity from the connector. The retainer cap 169 as attached to the first connector member in this view shows the openings 172 through the end 170 for accommodating passage of wires 174 that are connected with respective the electrical terminals inside of the first connector member. As illustrated, this example is for a J650 type connector comprising seven wires and respective electrical terminals arranged in a desired pattern.

FIG. 3B shows a side view of the assembled electrical cable connector 100 illustrating the cap 140 in a closed position over the second connector member first open end 130. The second connector member 126 is attached to the first connector member 110, and such attachment is retained to a predetermined decoupling or breakaway force by engagement of the first connector member and second connector member surface features 146 and 148. As illustrated, in this example, the first connector member surface feature 146 is in the form of a projection that extends outwardly from the wall structure 118 and is disposed within the open slot 152 of the latch extending axially along the second connector member sleeve 138. In an example embodiment, the connector 3000 comprises a pair of such surface features positioned 180 degrees apart from one another. However, it is to be understood that electrical cable connectors as disclosed herein may comprise 1, or 2 or more such surface features depending on the particular electrical cable connector type and end-use application. The retainer cap 169 is releasably attached with the first connector member second wall structure 122, wherein such releasable attachment may be provided by engagement of a second wall structure surface feature 176 and a retainer cap surface feature 178.

In an example, the second wall structure surface feature 176 is provided in the form of a projection extending radially outwardly a distance therefrom, and the retainer cap surface feature 178 comprises a sleeve element extending axially a distance from the cap end 150 that is configured having an opening 182 therethough to capture the projection therein by deflection of the sleeve element 180 and fitment of the projection into the opening 182. In an example embodiment, the retainer cap 169 and first connector second wall structure 122 each comprise a pair of such respective surface features 176 and 178 positioned approximately 180 degrees apart from one another. However, it is to be understood that electrical connectors as disclosed herein may comprise 1, or 2 or more such surface features depending on the particular connector type and end-use application. The wires 174 are shown extending outwardly from the retainer cap end 170.

FIG. 3C shows a front view of the connector 300 illustrating the cap 140 as disposed over the second connector member 126, and the second connector member engaged with the first connector member 110, and the flange 120 extending from the first connector member. In an example, the cap 140 may include one or more surface features 141 for accommodating attachment between the cap and an electrical cable connected to the electrical connector. In an example, the surface features 141 may be a pair of openings to accommodate placement of an annular connector around the electrical cable and through the openings to thereby secure the electrical cable to the cap 140.

FIGS. 4A and 4B illustrate portions 400 an example electrical cable connector as discussed above, and specifically the attachment feature between the first and second connector members that operates to retain the connector members together during normal operation, and decouple or break away the connector members when subjected to a determined force load from the electrical cable, e.g., that may occur when the source of the electrical cable is moved relative to the object that the connector is attached to when electrical connection with the object is no longer desired. In an example, the determined force load may be greater than about 10 pounds, may be greater than about 20 pounds, may be up to about 100 pounds, may be between about 10 to 80 pounds, may be between about 20 to 60 pounds, and may be between about 50 to 70 pounds. As noted above, the first and second connector member surface features are engineered to provide such retention and decoupling upon exposure to such determined force load.

The first connector member surface feature is provided in the form of a projection 182 that extends a distance radially outwardly from the first connecter member first wall structure 118 and is positioned axially between the first connector member first open end and a floor or base from which the flange 120 projects. The projection 182 has a beam structure with a determined width and length. As best shown in FIG. 4B, the projection 182 includes a first or leading axial edge 186 having a cam angle calculated to enable the above-noted decoupling from the second connector member surface feature, and a second or trailing axial edge 188 having an angled surface to promote movement thereover by the second connector member surface as the second connector member is being attached with the first connector member. In an example, the cam angle of the first axial edge 186 may be from about 30 to 85 degrees, and from about 50 to 75 degrees, and from about 60 to 70 degrees relative to an axis running parallel with the first wall structure 118. In an example, the cam angle for the first axial edge 186 is approximately 70 degrees.

The second connector surface feature 148 is provided in the form of a latch extending axially along the sleeve from the second connector member first open end 130. The latch has a closed end 150 along a leading surface with an open slot 152 extending a length axially therefrom. The slot 152 is in the form of a channel having a width sized to accommodate the width of the projection 182 therein to provide a close fit. The latch closed end 150 is configured having an underside surface 192 adjacent the slot that engages with the projection first axial edge 186, and that has a cam surface that complements the first axial edge to provide the desired decoupling or breakaway feature at the determined force load. The latch closed end 150 is positioned a sufficient axial distance from its connection point with the second connector member to facilitate outwardly deflection of the latch from its engagement with the projection upon exposure to the determined force load. Together, the cam surfaces of such surface features and axial length of the latch operate to facilitate the above-described intended decoupling and break away of the first and second connector members when subjected to the above-described determined force load. As best shown in FIG. 4A, the first connector member side structure comprises guides 194 in the form of one or more raised ribs extending axially therealong that fit within complementary recessed channels 196 disposed along the second connector member sleeve 138. The guides operate to help align and guide engagement of the first and second connector members when placed together for sliding relative to one another into attached engagement.

Figure 5:
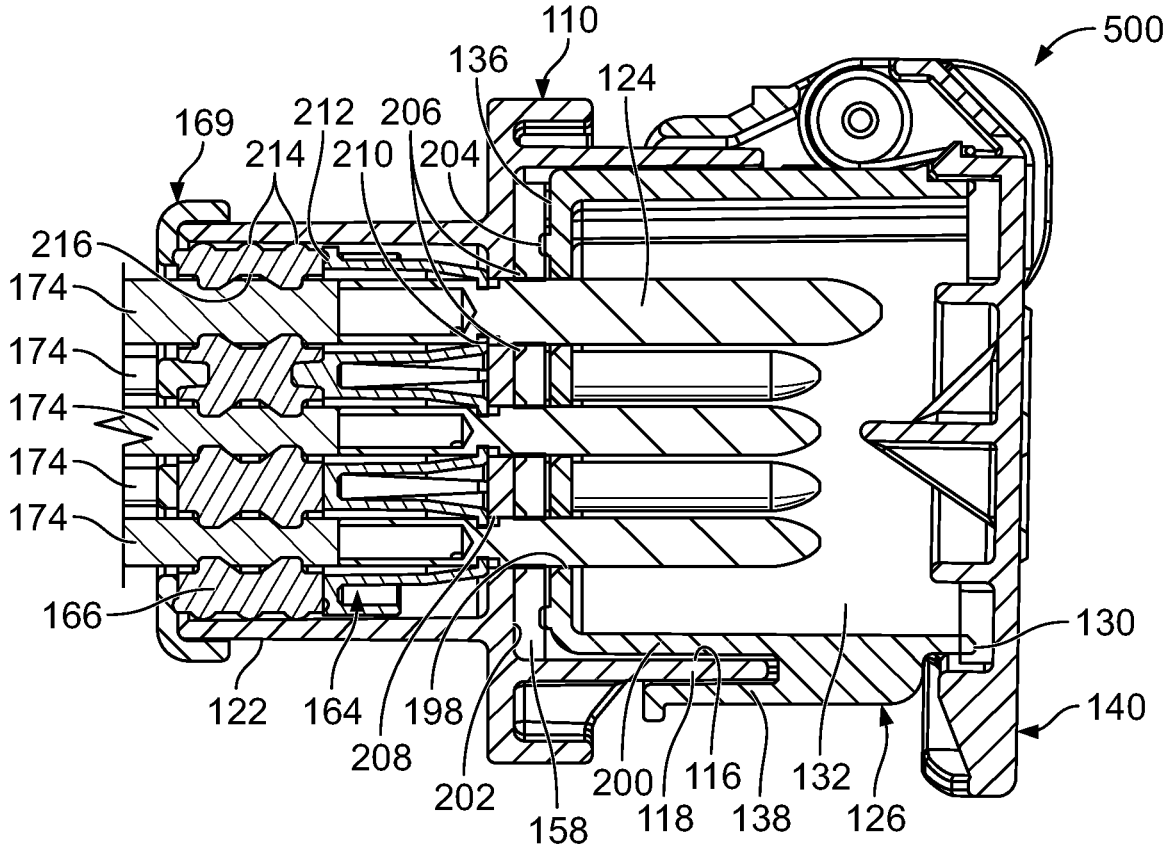
FIG. 5 illustrates a cross-sectional side view of an example electrical cable connector as disclosed herein.

FIG. 5 illustrates a cross-sectional view of the example embodiment electrical cable connector 500 as disclosed above comprising the first and second connector members 110 and 126 joined together and comprising the electrical terminals 124 disposed therein, and comprising the cap 140 disposed over the first open end 130 of the second connector member. The second connector member 126 is disposed within the first connector member internal cavity 116 such that the second connector member wall structure 200 is positioned concentrically within the first connector member wall structure 118, and first connector member wall structure 118 is interposed between the second connector member wall structure 200 and sleeve 138. The second connector member second end 136 is positioned adjacent the first connector member floor 202 and comprises a number of openings 198 therein for passage of the electrical terminals 124 therethrough for placement within the second connector member internal cavity 132 for connection with a plug of an electrical cable. The seal 158 is interposed between the first connector member floor 202 and the second connector member second end 136 and provides a leak tight seal both between the first and second connector members, and between the first and second connector members and the electrical terminals. In an example, the seal 158 is made from a foam material such as closed-cell foam of the like.

In an example, the second connector member second end 136 comprises one or more annular ribs 204 extending axially outwardly a distance therefrom that engages the seal to form a desired leak-tight fit therewith when the first and second connector members are attached together. In an example, the first connector member floor 202 may comprise a number of annular ribs 206 projecting axially outwardly therefrom that that are positioned around each of the electrical terminal openings 208 through the floor 202, wherein the ribs 206 press against the seal to compress the seal and cause the seal to better engage the electrical terminals. In an example, the ribs 206 have an angled configuration to as to cause the desired deflection of the seal radially inwardly towards the openings 208.

The electrical terminal retainer 164 is disposed within the internal cavity of the first connector member second wall structure 122 and comprises the electrical terminals disposed therein. Axial placement of the electrical terminals is fixed by engagement between inwardly directed ends 210 of each of the retainer openings and recessed grooves in each of the respective electrical terminals. A second end of the electrical terminal retainer 212 is positioned against the grommet 166, and the grommet 166 is interposed within the internal cavity of the first connector member second wall structure 122 between the retainer cap 169 and the retainer 164. The electrical terminals are connected with wires 174 and the wires extend through the grommet and retainer cap. The grommet provides a leak-tight seal between the wires and electrical terminals and the first connector member. As shown, the grommet may include one or more surface features 214, e.g., in the form of ribs or projections disposed long an outer diameter surface and/or along the inside diameters of the openings 216 for purposes of providing or enhancing such leak-tight fit.

Figure 6:
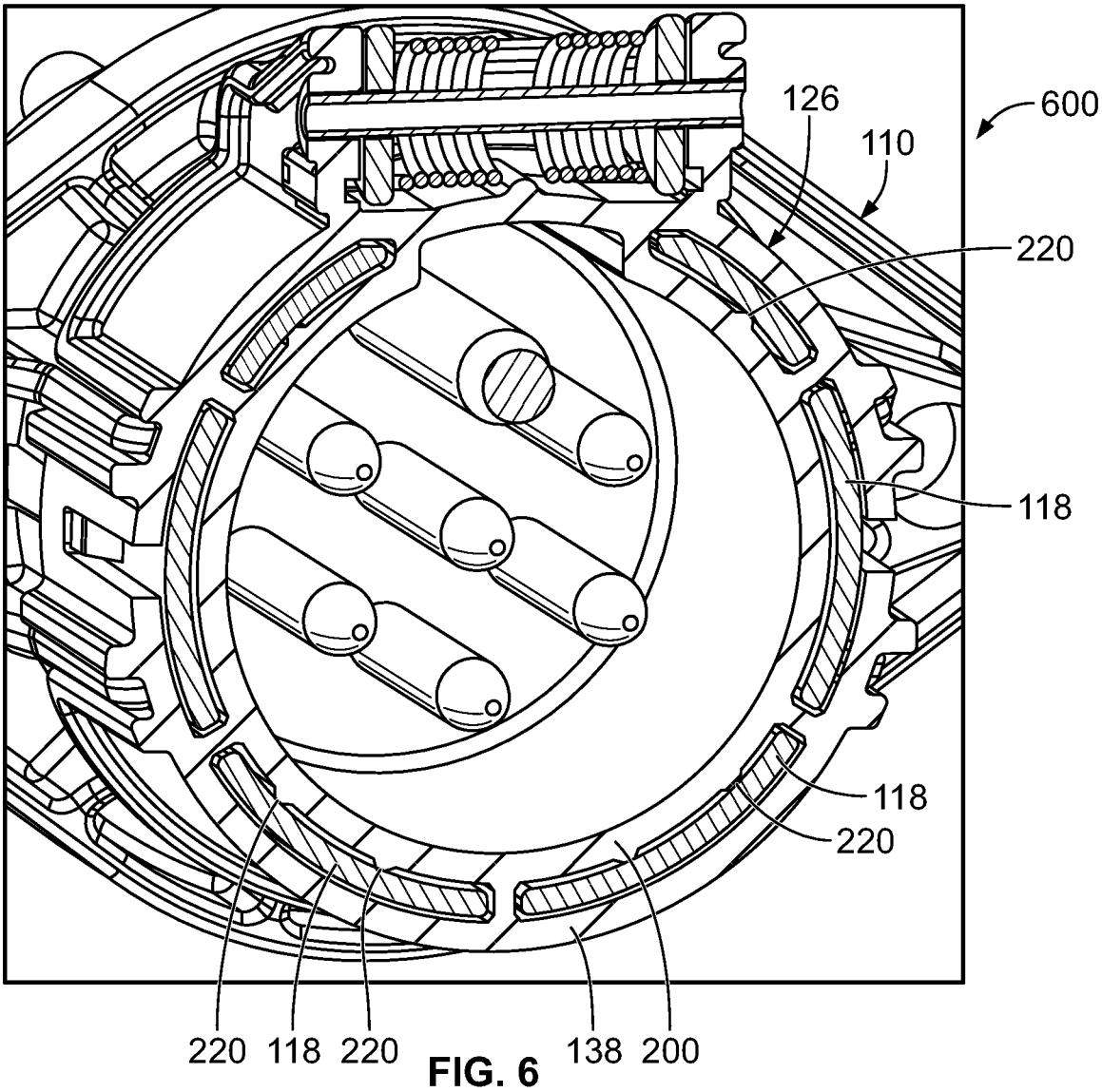
FIG. 6 illustrates a perspective view of section of an example electrical cable connector as disclosed herein.

FIG. 6 illustrates the electrical cable connector 600 as disclosed above, and more specifically the construction of the second connector member 126 and the manner in which it connects with the first connector member 110. This sectional view shows how the first connector member wall structure 118 is interposed within an annual space between the second connector member wall structure 200 and sleeve 138. In this example, the second connector member wall structure 200 is shown comprising a number of surface features in the form of ribs 220 extending radially outward a distance therefrom and running axially along a length of the wall structure 200. The ribs 220 may be provided for purposes of obtaining a desired interference fit with the first connector wall structure 118 without causing unwanted binding or the like that may exist by using larger surface area interface surface features. Thus, while surface features in the form of ribs have been illustrated, it is to be understood that other types of surface features may be used to provide a desired degree of fitment between the connectors without causing unwanted binding or the like, and that such is intended to be within the scope of this description. Additionally, the sleeve 138 may be constructed to provide a desired degree of side support to the connector to resist side loads place on the connector by the electrical cable or the like.

Figure 7A:
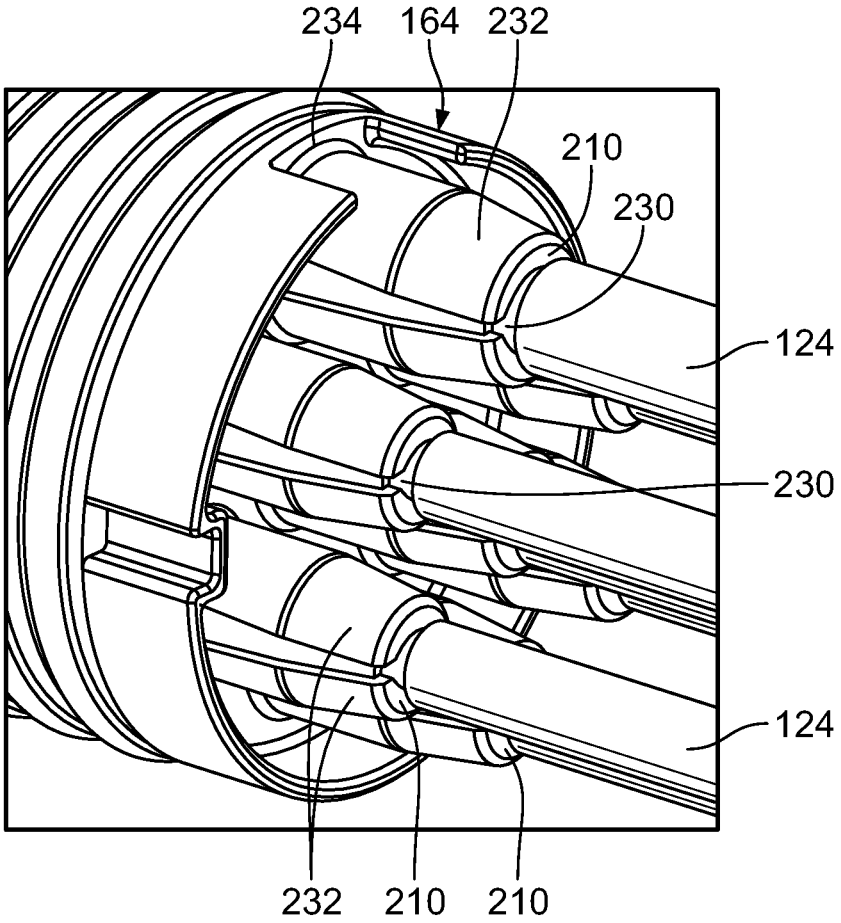
FIGS. 7A and 7B perspective views of different portions of an example electrical cable connector as disclosed herein.
Figure 7B:
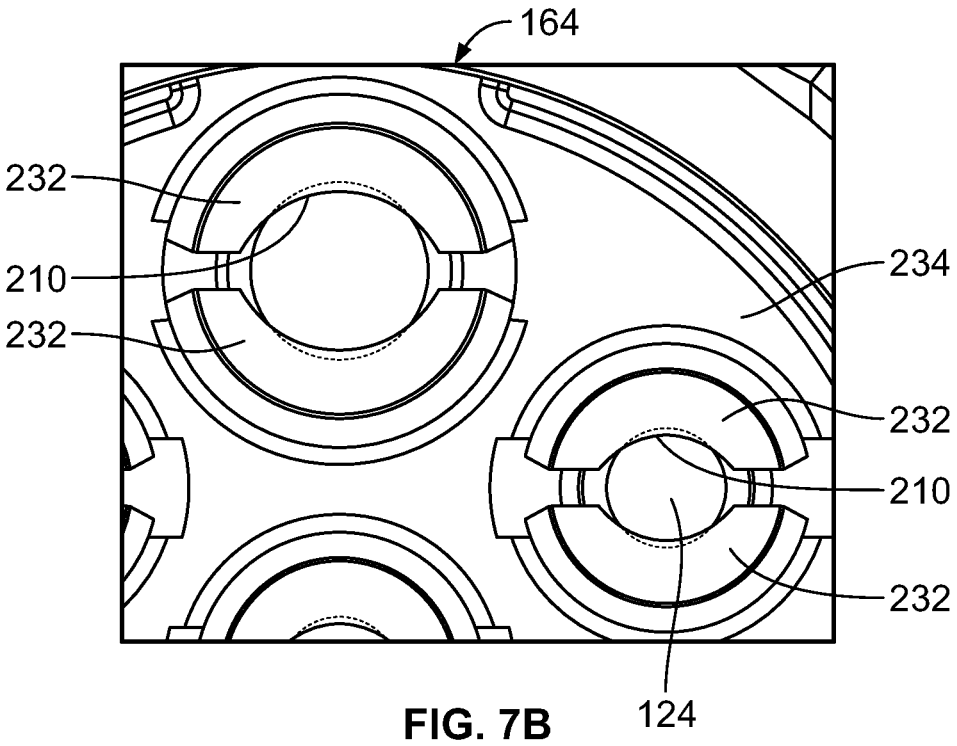

FIGS. 7A and 7B illustrate an example retainer 164 as disclosed herein for purposes of retaining the axial fitment of the electrical terminals within the electrical cable connector. The retainer 164 may be molded or formed from a plastic material and comprises openings with terminal ends 210 that are biased radially inwardly to engage the recessed grooves 230 of the electrical terminals 124. In an example, the openings are formed by a pair of wall sections 232 that are opposed from one another and that extend axially away from a base 234 of the retainer. The wall sections 232 are split or independent of one another and extend towards one another having a distance between than that is less than that of the electrical terminal to thereby engage and capture by deflection the electrical terminals therebetween. The terminal ends 213 of the wall sections have an inwardly directed or inverted wall that is configured to fit within the recessed groove of the electrical terminal. Configured in this manner, as the electrical terminal is passed through the opening and past the deflected wall sections, axial placement of the electrical terminal is fixed by engagement of the terminal end in the recessed groove. In an example, the inverted wall has a radius that is sized to both fit within the electrical terminal recessed groove, and to facilitate removal of the electrical terminal therefrom, e.g., through the use of a tool as better described below. In example, the inverted wall has a radius that matches an outside diameter of the electrical terminal existing outside of the recessed channel.

Figure 8A:
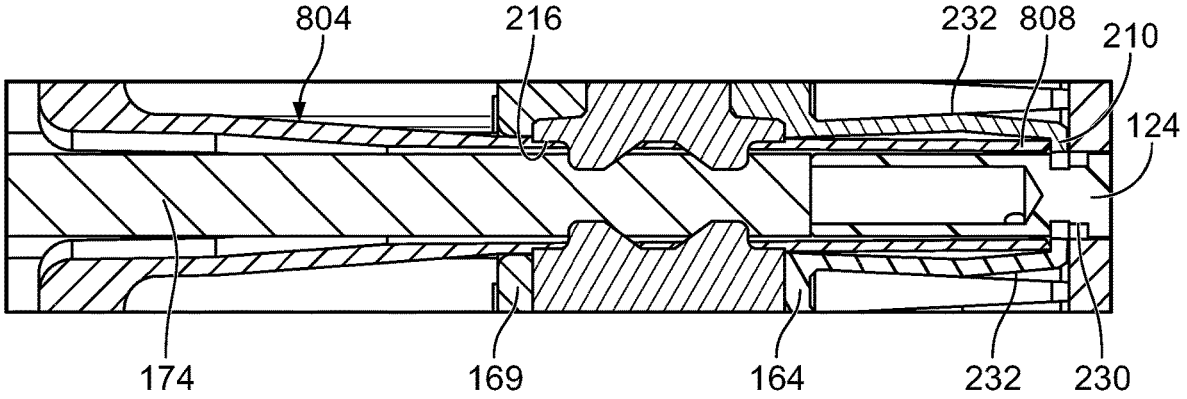
FIGS. 8A and 8B illustrate a cross-sectional view and a perspective view of an example electrical cable connector and a tool used with the same as disclosed herein.
Figure 8B:
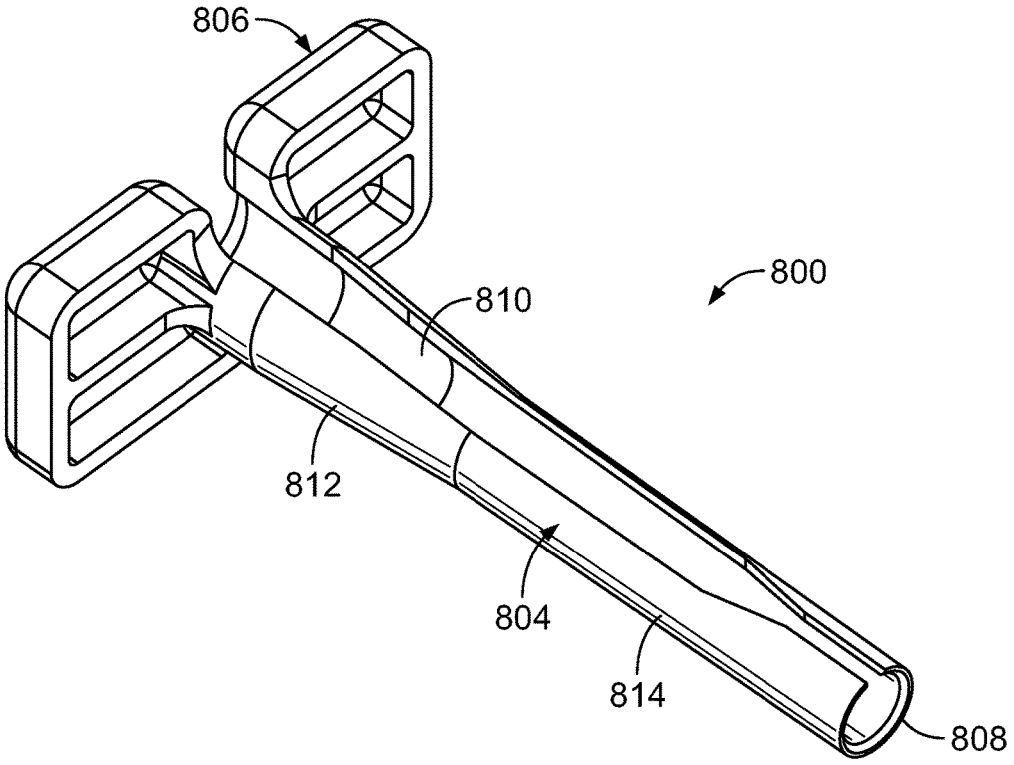

FIGS. 8A and 8B illustrate the electrical terminal retainer 164 as disclosed herein and a method for removing the electrical terminals 124 therefrom. FIG. 8A illustrates a tool 800 and useful for removing the electrical terminals from the retainer. The tool 800 has a generally cylindrical body 804 with flanged element 806 at one end of the body and a conical end 808 at an opposite end of the body. As best shown in FIG. 8B, each tool body has a tubular configuration and includes an open channel 810 extending axially between each of the ends for purposes of enabling the body to elastically radially deflect during use of the tool to remove an electrical terminal. In the illustrated example, the body 804 includes two sections; namely a first section 812 extending from the flanged element 806 and having a tapered configuration with a diameter that decreases moving axially a distance away from the flanged element, and a second section 814 having a substantially constant diameter moving to the conical end 808.

As best shown in FIG. 8A, the tool enables an electrical terminal to be removed from the connector by inserting a wire 174 of a respective electrical terminal 124 into the channel and into the tubular body, inserting the conical end 808 of the tool body through an opening in the retainer cap 169, and axially inserting the tool body 804 through the opening in the grommet 216, and over the outside diameter of the electrical terminal 124. Inserting the tool further into the retainer 164 causes the wall sections 232 to deflect radially outwardly until the tool body displaces the terminal ends 210 from engagement with the electrical terminal recessed grooves 230, thereby permitting the electrical terminal to be removed from the connector.

While electrical cable connectors have been disclosed above with reference to the example illustrated in FIGS. 1 to 8B as disclosed above with reference the above-noted figures, it is to be understood that electrical cable connectors as disclosed herein may be configured differently while being within the scope and spirt of this disclosure. Accordingly, it is to be understood that electrical cable connectors within the scope of this disclosure are not intended to be limited to any particular embodiment, and electrical cable connectors comprising the features disclosed herein may be provided having a variety of different embodiments.

Figure 9A:
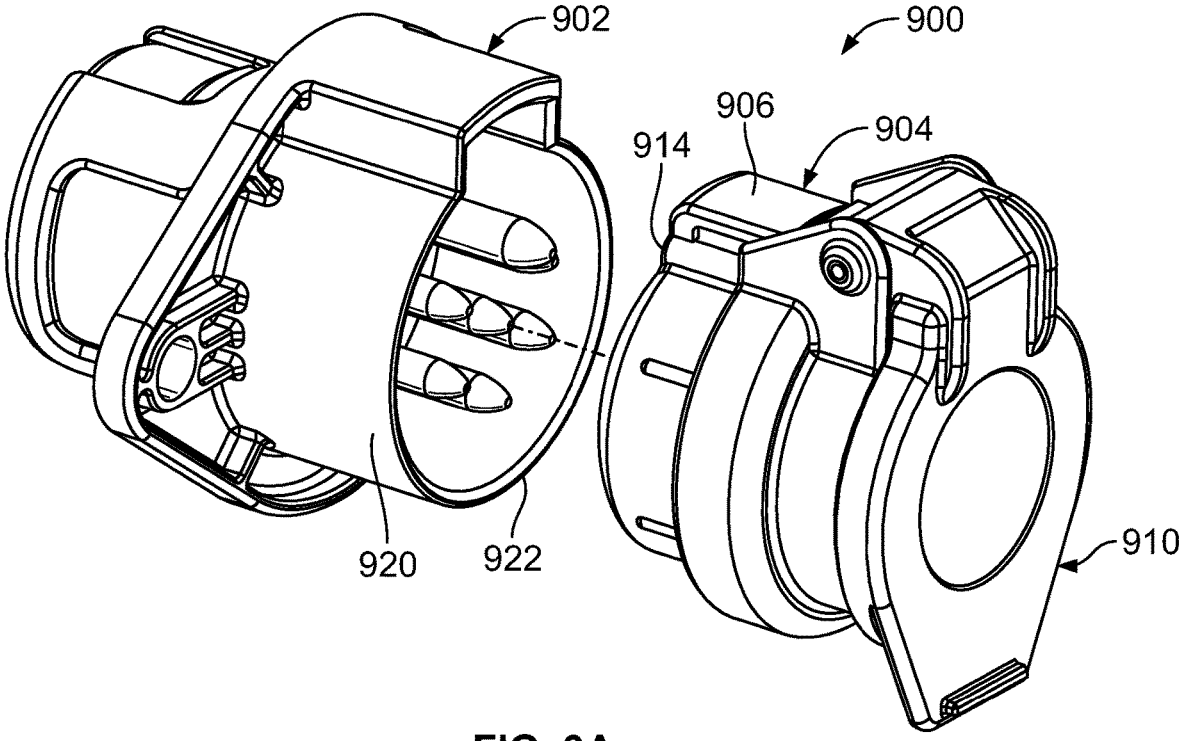
FIGS. 9A and 9B illustrate in perspective and cross-sectional side views another example embodiment electrical cable connector as disclosed herein.
Figure 9B:
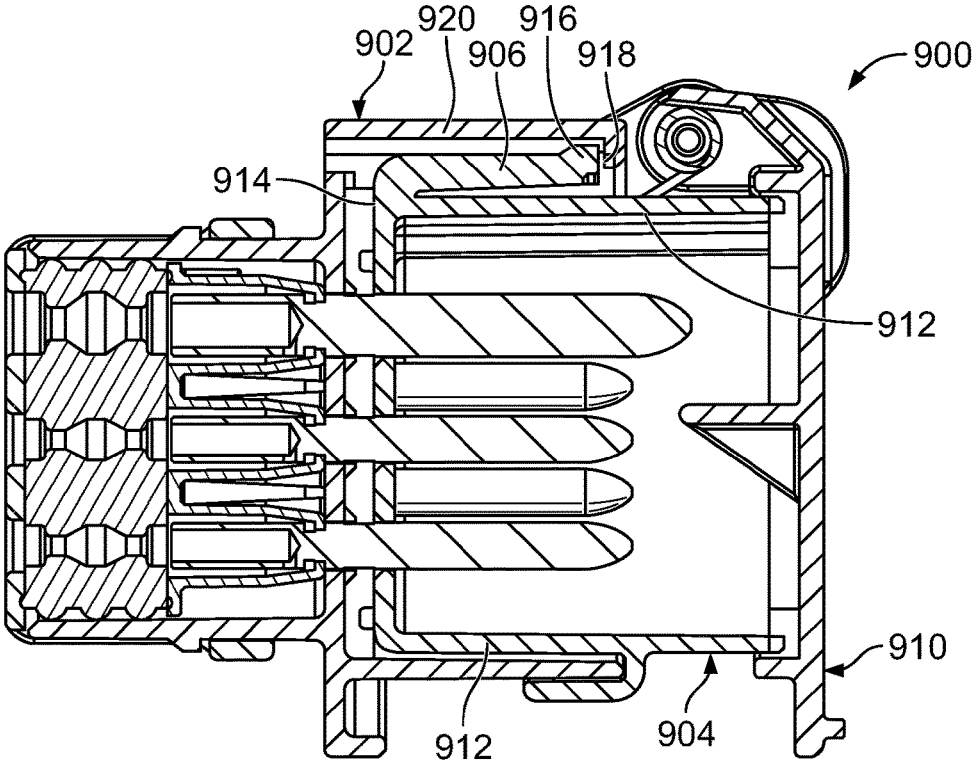

FIGS. 9A and 9B illustrate an example embodiment electrical cable connector 900 as disclosed herein. This example electrical connector is somewhat similar to the example electrical connector disclosed above, except for the placement and configuration of the surface features that provide desired decoupling or breaking away of the first and second connector members 902 and 904 from one another under a determined external pulling force or load as discussed above. In this example, the second connector member 904 comprises a surface feature 906 that is disposed along a top section of the second connector member adjacent the cap 910 and positioned outwardly from the second connector member wall structure 912. In an example, the surface feature 906 is provided in the form of a latch that is integral with and that extends axially from a second end 914 of the second connector member towards the cap 910. The latch extends from the second end 914 to a terminal end 916 that is configured to engage with a lip 918 that extends inwardly from an adjacent and opposed portion of the first connector member wall structure 920 at the first open end 922. The latch is engineered to deflect inwardly in the event that the engaged surfaces between the latch terminal end 916 and the first connector member lip 918 are subjected to the above-described determined load or pull force to thereby cause the first and second connector members to decouple and break away from one another.

A feature of electrical cable connectors as disclosed herein is that the first and second connector members are engineered having surface features that designed cooperate with one another to provide a desired attachment to promote connection with an electrical cable during use, which surface features are also specifically constructed to decouple or break away when subjected to a determined force without causing damage to the connector, thereby promoting reuse without repair or replacement. A further feature of electrical cable connectors as disclosed herein is the manner in which the electrical terminals are retainer therein, through the use of a specially constructed retainer that enables the electrical terminals to be removed from the connector without having to disassemble the connector. A still further feature of electrical cable connectors as disclosed herein is the ability to provide the above-noted features while also providing a leak-tight assembly.

The foregoing description and accompanying figures illustrate the principles, preferred embodiments and modes of operation of electrical cable connectors as disclosed herein. However, such electrical cable connectors should not be construed as being limited to the particular embodiments discussed above. Additional variations of the embodiments discussed above will be appreciated by those skilled in the art. Therefore, the above-described embodiments should be regarded as illustrative rather than restrictive. Accordingly, it should be appreciated that variations to those embodiments can be made by those skilled in the art without departing from the scope of the cable seal systems and connectors as defined by the following claims.

What is claimed is:

1. An electrical cable connector comprising: a first member comprising a body having an internal cavity extending from an open end to a floor, wherein the body comprises a wall structure extending axially between the open end and floor, wherein a number of electrical terminals extend through the floor and into the internal cavity; and a second member comprising an internal cavity extending from a second member open end to a second member floor, the second member comprising a wall structure extending axially between the second member open end and the second member floor, wherein the second member comprises a sleeve disposed concentrically around an outside surface of the second member wall structure, wherein the second member is disposed within the first member internal cavity with the second member wall structure positioned within the first member wall structure, wherein the second member floor is positioned adjacent the first member floor, wherein the second member floor accommodates placement of the electrical terminals therethrough into an internal cavity of the second member; wherein the second member is removably connected with the first member by engagement of one or more second member surface features with one or more complementary first member surface features, wherein the one or more surface features of the first member are disposed along an outside surface of the first member wall structure.

2. The electrical cable connector as recited in claim 1 wherein the surface features of the first and second members are designed to permit the second member to be disengaged from the first member under a load of greater than about 10 lbs.

3. The electrical cable connector as recited in claim 1 wherein the first member surface feature comprises a projection extending from a portion of the first member wall structure, and wherein the second member surface feature is disposed outwardly from the second member wall structure and is configured to engage and register with the projection.

4. The electrical cable connector as recited in claim 1 wherein the second member surface feature extends from the sleeve.

5. The electrical cable connector as recited in claim 3 wherein the second member surface feature comprises a latch extending axially from the second member sleeve configured to engage and register with the projection.

6. The electrical cable connector as recited in claim 1 wherein the first member comprises a flange extending radially outward a distance from the first member wall structure adjacent the first member floor.

7. The electrical cable connector as recited in claim 6 wherein the entirety of the second member as disposed in the first member internal cavity is disposed above the flange.

8. The electrical cable connector as recited in claim 1 wherein the second member is configured to accommodate placement of the first member wall structure between the sleeve and the second member wall structure.

9. The electrical cable connector as recited in claim 1 wherein the first member wall structure includes one or more guide surface features disposed along the outside surface of the first member wall structure to register with complementary surface features of the second member to guide alignment during fitment of the first and second members together.

10. An electrical cable connector comprising:

a first member comprising a body having an internal cavity extending from an open end to a floor, wherein the body comprises a cylindrical wall extending axially between the open end and the floor;

a second member comprising an internal cavity comprising a cylindrical wall extending from a second member open end to a second member floor, the second member being disposed within the first member internal cavity with the second member floor positioned adjacent the first member floor, wherein the second member comprises a sleeve disposed around the second member wall, and wherein at least a portion of the first member wall is interposed between the second member wall and sleeve; and a number of electrical terminals extending from a backside surface of the first member floor therethrough and into the first member cavity, wherein the terminals extend into the second member cavity for attachment with an electrical cable when disposed in the second member internal cavity;

wherein the first and second member include complementary surface features for maintaining attachment between the first and second members, wherein the surface features are configured to facilitate detachment of the first and second members at a determined force.

11. The electrical cable connector as recited in claim 10 wherein the first member surface feature is disposed along an outside surface of the cylindrical wall.

12. The electrical cable connector as recited in claim 10 wherein the second member surface feature is disposed along the sleeve.

13. The electrical cable connector as recited in claim 10 wherein the second member floor comprises a number of openings therethrough for accommodating passage of the electrical terminals from the first member internal cavity into the second member internal cavity, and wherein the connector comprises an elastomeric sealing element interposed between the first and second member floors to provide a leak-tight seal between the first and second members, and to provide a leak-tight seal with the electrical terminals.

14. The electrical cable connector as recited in claim 10 wherein the first member surface feature is a projection disposed along an outside surface of the cylindrical wall, and wherein the second member surface feature is part of the sleeve and configured to engage and register with projection.

15. The electrical cable connector as recited in claim 14 wherein the element is a latch that extends axially a distance away from the second member open end and that includes a slotted opening to accommodate fixed placement of the projection therein.

16. The electrical cable connector as recited in claim 15 wherein the surface features disengage to facilitate detachment of the first and second members when subjected to a force of greater than about 10 pounds.

17. A method for providing a detachable connection in an electrical cable connector when subject to a determined electrical cable force, the method comprising: combining a first connector member with a second connector member, wherein the first connector member comprises an internal cavity having a wall structure extending from an open end to a floor, wherein the second connector member comprises a wall structure extending from a second connector member open end to a second connector member floor and is disposed within the first connector member internal cavity, wherein the first connector member includes a flange along the first connector member wall structure adjacent the first connector member floor that is connected to an external object to thereby fix the first connector member, wherein during the step of combining, the second connector member is disposed within the first connector member internal cavity and a surface feature of the first connector member positioned along an outside surface of the first connector member wall structure engages a surface feature of the second connector member disposed along a sleeve positioned around the second connector member wall structure to form an attachment therebetween, wherein the second connector member includes a number of electrical terminals extending within a second connector member internal cavity; inserting an electrical cable into the second connector member internal cavity and making electrical connection between the cable and the electrical terminals, wherein the second connector member includes a cap having a locking element that attaches with a portion of the electrical cable to retain attachment of the electrical cable to the second connector member; and imposing a pulling force on the electrical cable of greater than about 10 pounds causing the surface features of the first and second connector members to disengage, and causing the second connector member to detach with the electrical cable from the first connector member.

18. The method as recited in claim 17 wherein, during the step of combining, engaging the surface feature of the second connector member in the form of a latch element with the surface feature of the first connector member in the form of a projection.

19. The method as recited in claim 17 wherein during the step of combining, the first connector member wall structure is interposed between the second connector member wall structure and sleeve.

20. The method as recited in claim 17 where after the step of combining, the first connector member includes guide elements disposed along the first connector member wall structure, wherein the guide elements register with one or more elements of the second connector member outside surface to guide aligned combination of the first and second connector members.

* * * * *